US009123299B2

(12) United States Patent
Kim et al.

(10) Patent No.: US 9,123,299 B2
(45) Date of Patent: Sep. 1, 2015

(54) LIQUID CRYSTAL DISPLAY DEVICE INCLUDING LED UNIT USING CURRENT MIRROR CIRCUIT

(75) Inventors: Kee-Chul Kim, Suwon-si (KR); In-Jae Chung, Gwachaeon-si (KR); Sin-Ho Kang, Suwon-si (KR); Yeun-hyeok Yang, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 806 days.

(21) Appl. No.: 12/895,199

(22) Filed: Sep. 30, 2010

(65) Prior Publication Data

US 2011/0075072 A1 Mar. 31, 2011

(30) Foreign Application Priority Data

Sep. 30, 2009 (KR) ..... 10-2009-0093170
Jun. 23, 2010 (KR) ..... 10-2010-0059623
Jul. 16, 2010 (KR) ..... 10-2010-0068895

(51) Int. Cl.
*G09G 3/30* (2006.01)
*G09G 3/34* (2006.01)

(52) U.S. Cl.
CPC ..... *G09G 3/3426* (2013.01); *G09G 2320/0646* (2013.01); *G09G 2320/0686* (2013.01); *G09G 2330/021* (2013.01)

(58) Field of Classification Search
CPC ..... G09G 3/06–3/19; G09G 3/34–3/3426
USPC ..... 345/39, 44, 46, 48–50, 76–104
See application file for complete search history.

(56) References Cited

U.S. PATENT DOCUMENTS 6,859,193 B1 * 2/2005 Yumoto ..... 345/82
2002/0180369 A1 * 12/2002 Koyama ..... 315/169.1
2003/0122747 A1 * 7/2003 Shannon et al. ..... 345/76
2004/0056852 A1 * 3/2004 Shih et al. ..... 345/204
2005/0041002 A1 2/2005 Takahara et al.
2005/0190177 A1 9/2005 Yumoto
2006/0092346 A1 * 5/2006 Moon et al. ..... 349/61
2007/0242031 A1 * 10/2007 Kimura et al. ..... 345/102
2008/0094327 A1 * 4/2008 Koyama ..... 345/87
2008/0150877 A1 * 6/2008 Chao et al. ..... 345/102
2008/0158137 A1 * 7/2008 Yoshida ..... 345/102
2008/0245949 A1 * 10/2008 Morimoto et al. ..... 250/205
2009/0078853 A1 * 3/2009 Lin ..... 250/205
2009/0128471 A1 * 5/2009 Hsiao et al. ..... 345/88
2009/0309855 A1 * 12/2009 Wang et al. ..... 345/204

FOREIGN PATENT DOCUMENTS

KR 1020060012989 2/2006

* cited by examiner

*Primary Examiner* — Sanghyuk Park
(74) *Attorney, Agent, or Firm* — Dentons US LLP

(57) ABSTRACT

A liquid crystal display device includes a liquid crystal panel; a plurality of light emitting diode units to supply light to the liquid crystal panel; and a scan line and a light emission data line connected to the LED unit, wherein the scan line and the light emission data line transfer a scan signal and a light emission data current, respectively, wherein the LED unit includes: a switching circuit that is connected to the scan line and the light emission data line; a current mirror circuit that is connected to the switching circuit, and that outputs a light emission current in response to the light emission data current; and an LED that emits the light in response to the light emission current.

12 Claims, 13 Drawing Sheets

LIQUID CRYSTAL DISPLAY DEVICE INCLUDING LED UNIT USING CURRENT MIRROR CIRCUIT

The present invention claims the benefit of Korean Patent Application Nos. 10-2009-0093170, 10-2010-0059623, and 10-2010-0068895 filed in Korea on Sep. 30, 2009, Jun. 23, 2010, and Jul. 16, 2010, respectively, which are hereby incorporated by reference for all purposes as if fully set forth herein.

BACKGROUND OF THE INVENTION

1. Field of the Invention

The present invention relates to a liquid crystal display device.

2. Discussion of the Related Art

Until recently, display devices have typically used cathode-ray tubes (CRTs). Presently, many efforts and studies are being made to develop various types of flat panel displays, such as liquid crystal display (LCD) devices, plasma display panels (PDPs), field emission displays, and electro-luminescence displays (ELDs), as a substitute for CRTs. Of these flat panel displays, LCD devices have many advantages, such as high resolution, light weight, thin profile, compact size, and low voltage power supply requirements.

In general, an LCD device includes two substrates that are spaced apart and face each other with a liquid crystal material interposed between the two substrates. The two substrates include electrodes that face each other such that a voltage applied between the electrodes induces an electric field across the liquid crystal material. Alignment of the liquid crystal molecules in the liquid crystal material changes in accordance with the intensity of the induced electric field into the direction of the induced electric field, thereby changing the light transmissivity of the LCD device. Thus, the LCD device displays images by varying the intensity of the induced electric field.

The LCD device uses a backlight to supply light to a liquid crystal panel. A cold cathode fluorescent lamp (CCFL) and an external electrode fluorescent lamp (EEFL) are widely used as the backlight. Recently, a light emitting diode (LED) has been used as the backlight.

FIG. 1 is a schematic view illustrating a backlight using LEDs according to the related art.

Referring to FIG. 1, the backlight 40 includes a plurality of LED blocks BLK that each include a plurality of LEDs. The backlight 40 is below a liquid crystal panel to supply light to the liquid crystal panel. This type backlight 40 is referred to as a direct type backlight.

The LEDs of each LED block BLK are connected in series, and connected to a constant-current source circuit CRC. The constant-current source circuit CRC supplies a constant current to the block BLK, and the LEDs of the block BLK thus emit light.

A plurality of constant-current source circuits CRC are generally configured in one multi-channel driving IC. Accordingly, the multi-channel driving IC drives the blocks BLK the number of which corresponds to the number of the channels of the multi-channel driving IC. Therefore, to drive the backlight 40 of the related art, many driving ICs are required.

However, as the size of the LCD device increases or the backlight 40 having high brightness are required, the number of the LEDs should increase. Accordingly, the number of the blocks BLK should increase, and the number of the driving ICs should increase. Therefore, costs for circuit components to drive the LEDs increases.

To reduce the cost, an increase of the number of the LEDs in each block BLK may be considered. However, this causes increase of power consumption.

Further, since the LEDs in each block BLK are driven in common by the same constant-current source circuit CRC, a halo phenomenon increases and contrast ratio is limited. Therefore, display quality is reduced.

SUMMARY OF THE INVENTION

Accordingly, the present invention is directed to a liquid crystal display device which substantially obviates one or more of the problems due to limitations and disadvantages of the related art.

An advantage of the present invention is to provide a liquid crystal display device that can improve display quality, reduce costs of circuit components, and reduce power consumption.

Additional features and advantages of the present invention will be set forth in the description which follows, and in part will be apparent from the description, or may be learned by practice of the invention. These and other advantages of the invention will be realized and attained by the structure particularly pointed out in the written description and claims thereof as well as the appended drawings.

To achieve these and other advantages and in accordance with the purpose of the present invention, as embodied and broadly described herein, a liquid crystal display device includes: a liquid crystal panel; a plurality of light emitting diode units to supply light to the liquid crystal panel; and a scan line and a light emission data line connected to the LED unit, wherein the scan line and the light emission data line transfer a scan signal and a light emission data current, respectively, wherein the LED unit includes: a switching circuit that is connected to the scan line and the light emission data line; a current minor circuit that is connected to the switching circuit, and that outputs a light emission current in response to the light emission data current; and an LED that emits the light in response to the light emission current.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to the illustrated embodiments of the present invention, which are illustrated in the accompanying drawings.

Figure 1:
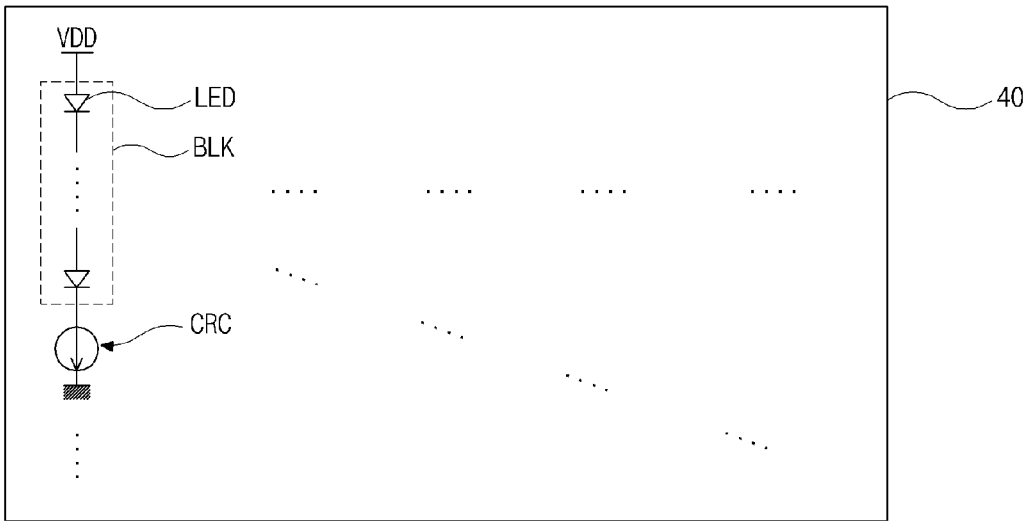
FIG. 1 RELATED ART
FIG. 1 is a schematic view illustrating a backlight using LEDs according to the related art.
Figure 2:
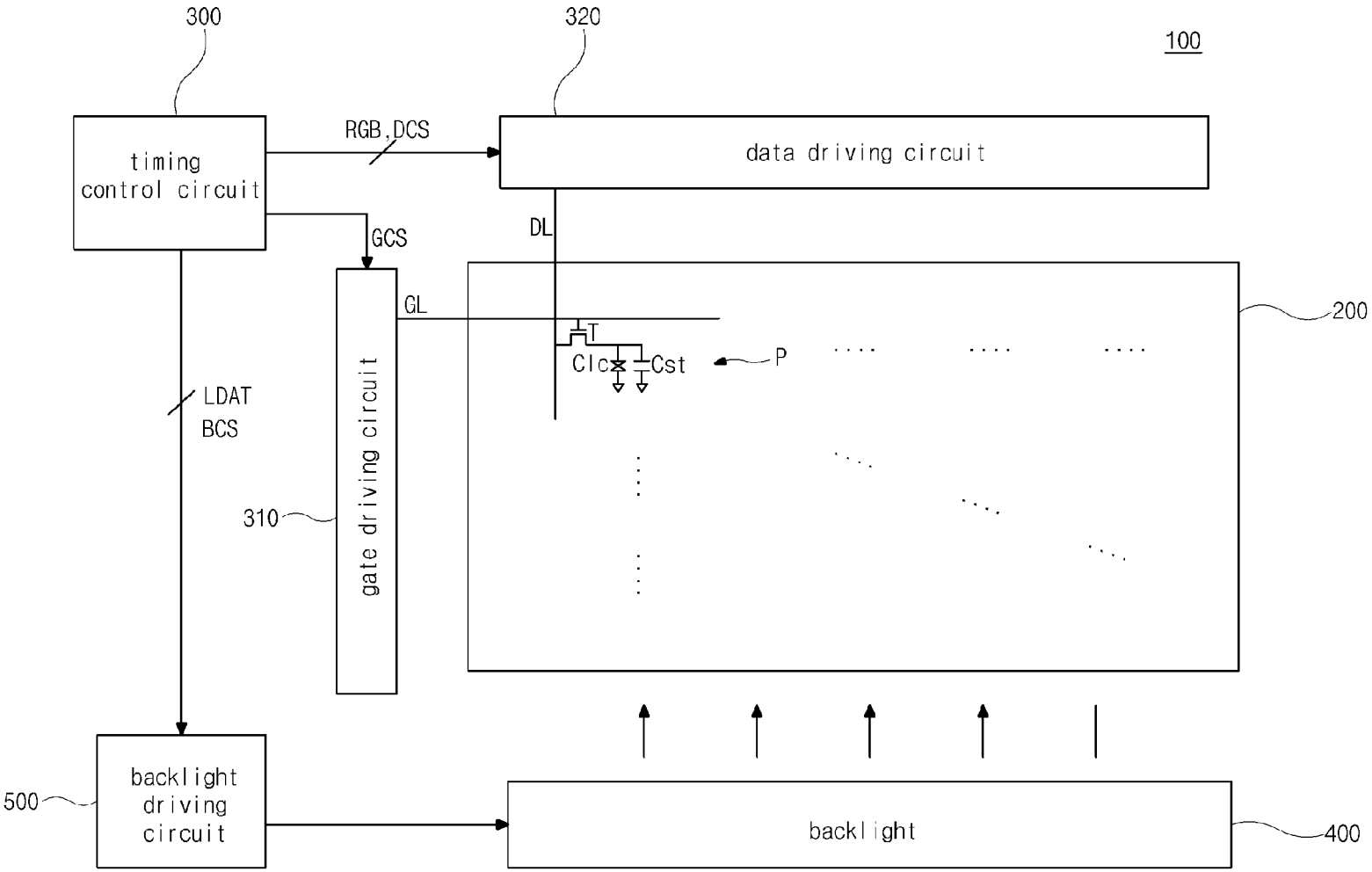
FIG. 2 is a schematic view illustrating an LCD device according to a first embodiment of the present invention.
Figure 3:
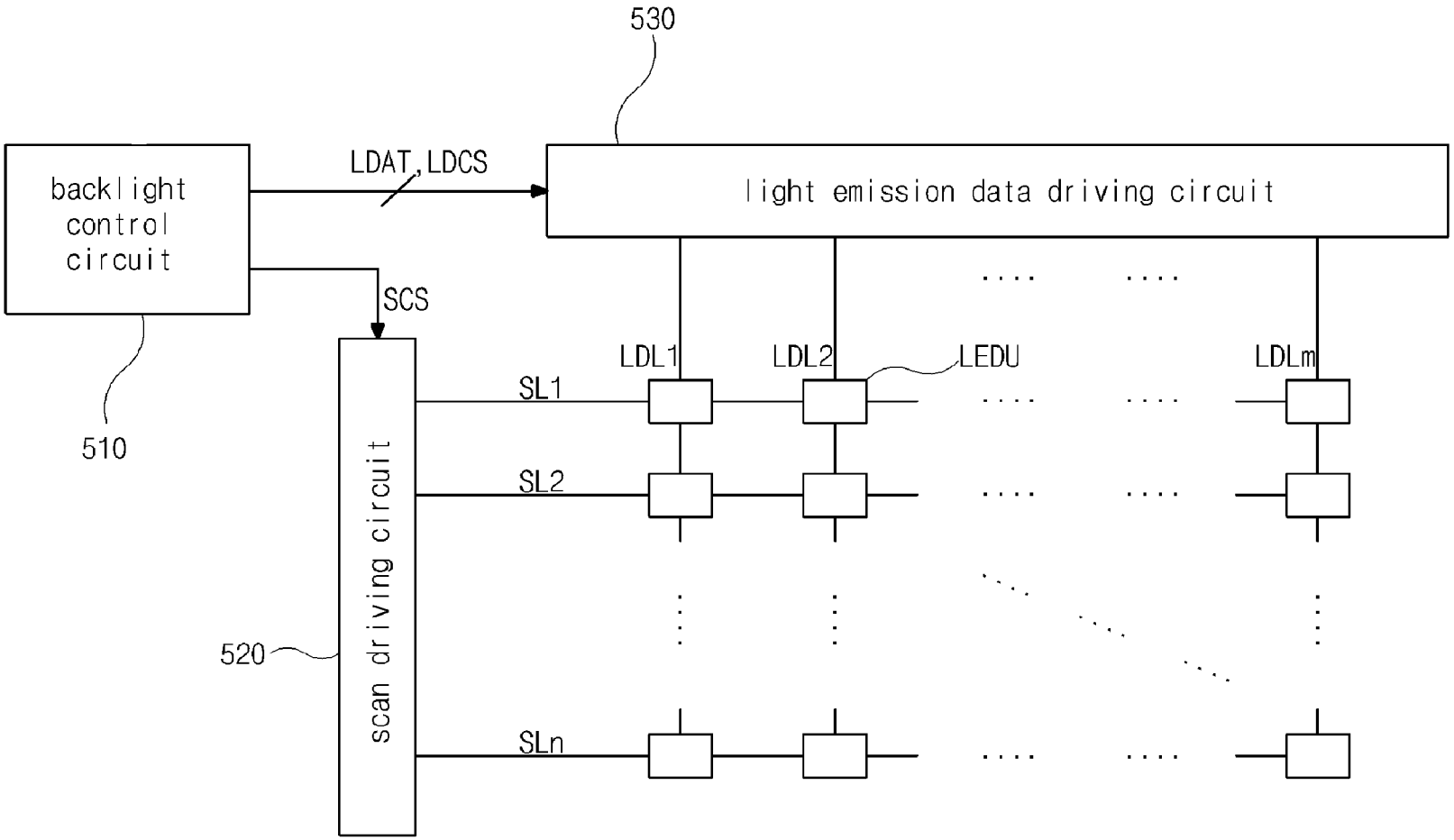
FIG. 3 is a schematic view illustrating a backlight and a backlight driving circuit of the LCD device according to the first embodiment of the present invention.
Figure 4:
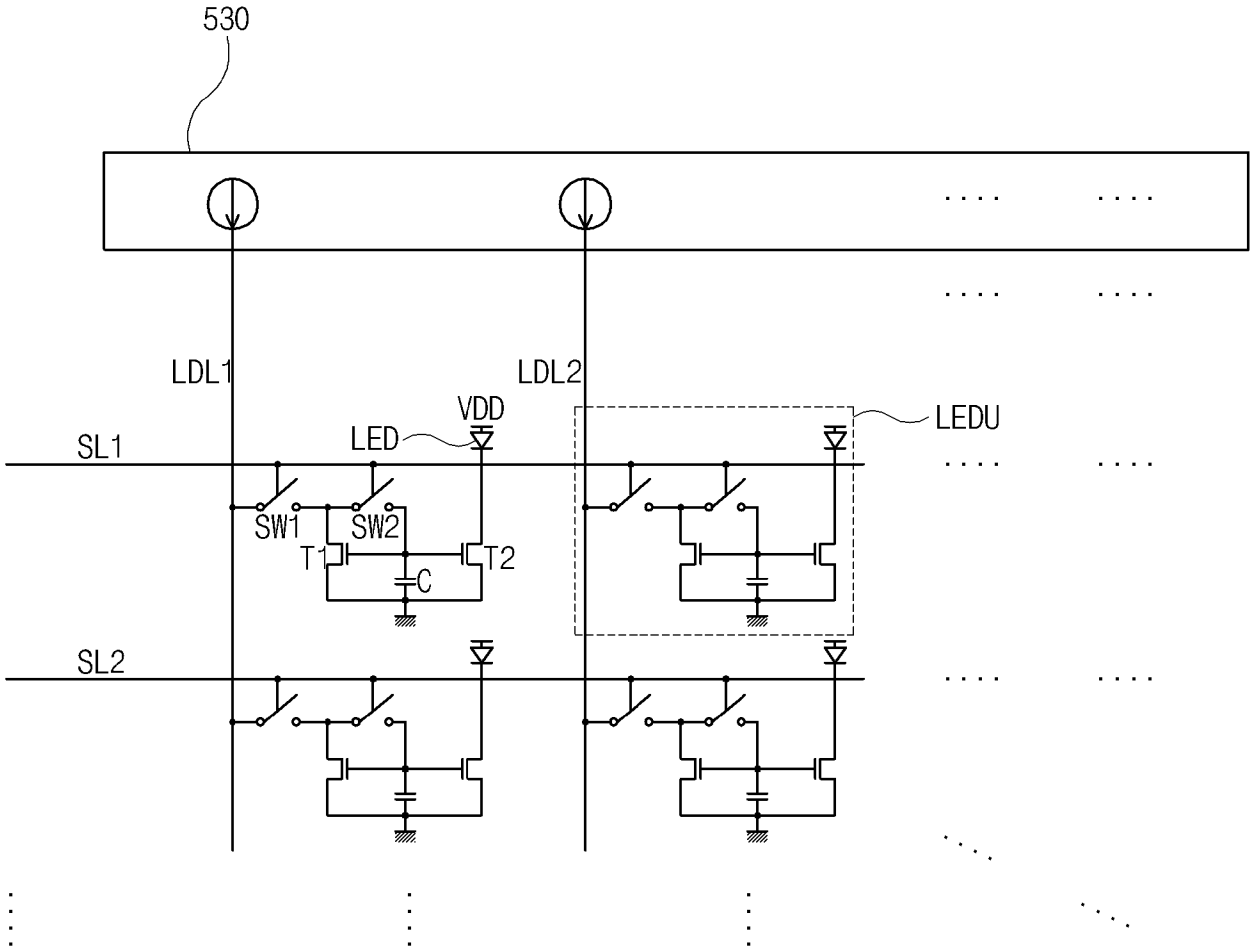
FIG. 4 is a schematic view illustrating an LED unit of the LCD device according to the first embodiment of the present invention.
Figure 5:
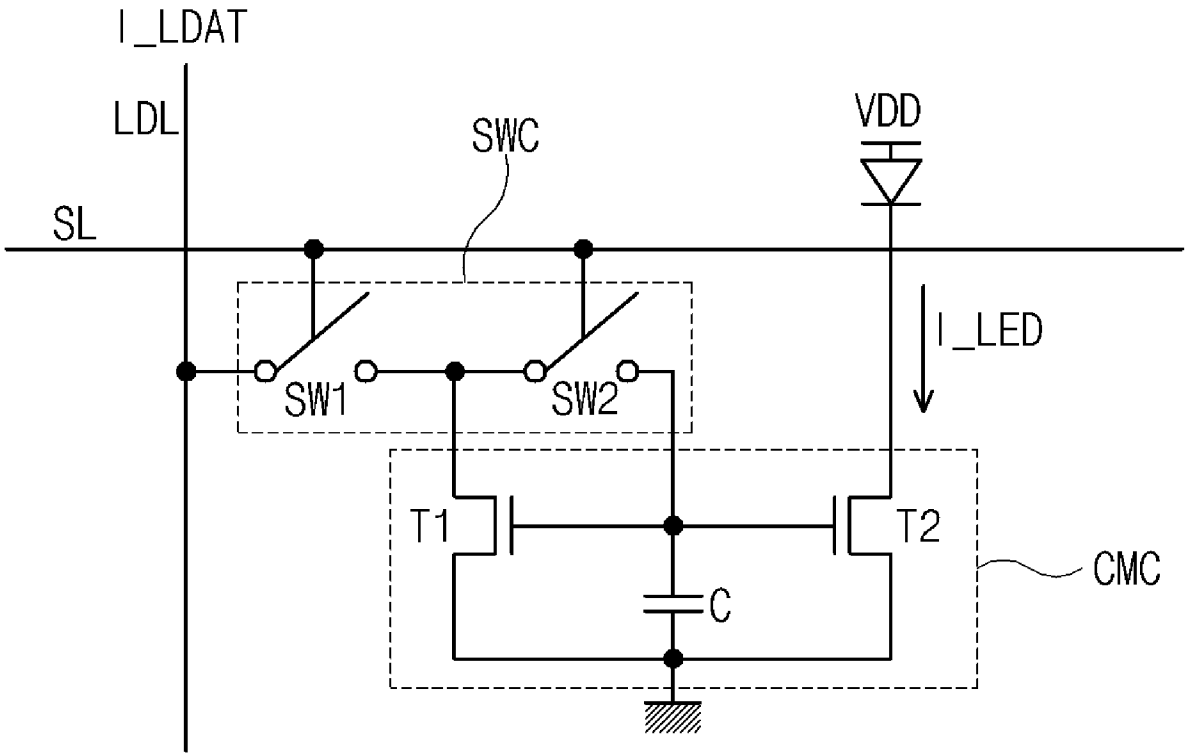
FIG. 5 is a view illustrating a method of driving the LED unit of the LCD device according to the first embodiment of the present invention.

FIG. 2 is a schematic view illustrating an LCD device according to a first embodiment of the present invention, FIG. 3 is a schematic view illustrating a backlight and a backlight driving circuit of the LCD device according to the first embodiment of the present invention, FIG. 4 is a schematic view illustrating an LED unit of the LCD device according to the first embodiment of the present invention, and FIG. 5 is a view illustrating a method of driving the LED unit of the LCD device according to the first embodiment of the present invention.

Referring to FIGS. 2 and 5, the LCD device 100 includes a liquid crystal panel 200, a driving circuit, and a backlight 400. The driving circuit includes a timing control circuit 300, a gate driving circuit 310, a data driving circuit 320, and a backlight driving circuit 500.

The liquid crystal panel 200 includes a plurality of gate lines GL and a plurality of data lines DL crossing each other, and a plurality of pixels P arranged in a matrix form. The gate and data lines GL and DL are connected to the corresponding pixel P.

A switching transistor T is formed in the pixel P and connected to the gate and data lines GL and DL. A pixel electrode is connected to the switching transistor T. A common electrode faces the pixel electrode. The common and pixel electrodes, and a liquid crystal layer therebetween form a liquid crystal capacitor Clc. A pixel storage capacitor Cst may be formed in the pixel P. The pixel storage capacitor Cst functions to store a data voltage supplied to the pixel P.

The pixels P in the liquid crystal panel 200 may include red, green and blue pixels. The red, green and blue pixels are supplied with red (R), green (G) and blue (B) image data signals, respectively, and transmit red, green and blue light, respectively. Neighboring red, green and blue pixels form an image display unit.

The timing control circuit 300 is supplied from an external system, such as a TV system or video card, with image data signals RGB, a vertical synchronizing signal, a horizontal synchronizing signal, a clock signal, a data enable signal and the like. Even though not shown in the drawings, these signals may be supplied to the timing control circuit 300 through an interface circuit.

The timing control circuit 300 produces a gate control signal GCS to control the gate driving circuit 310, and a data control signal DCS to control the data driving circuit 320. The gate control signal GCS may include a gate start pulse, a gate shift clock, a gate output enable signal, and the like. The data control signal DCS may include a source start pulse, a source shift clock, a source output enable signal, a polarity signal and the like.

Further, the timing control circuit 300 produces a backlight control signal BCS to control the backlight driving circuit 500. Further, the timing control circuit 300 may produce light emission data signals LDAT to control brightness of LEDs, and each light emission data signal may correspond to each LED.

Even though not shown in the drawings, a gamma reference voltage generator generates a plurality of gamma reference voltages and supplies the gamma reference voltages to the data driving circuit 320. A power supply supplies voltages to operate components of the LCD device 100.

The gate driving circuit 310 sequentially scans the gate lines GL in response to the gate control signal GCS in each image frame. In a scan period for the gate line GL, the gate driving circuit 310 outputs a turn-on voltage to the gate line GL to turn on the switching transistor T connected to the gate line GL. In a non-scan period for the gate line GL, the gate driving circuit 310 outputs a turn-off voltage to the gate line GL.

The data driving circuit 320 outputs an image data voltage to the corresponding data line DL in response to the data control signal DCS. The data driving circuit 320 generates the image data voltage corresponding to the image data signal using the gamma reference voltages.

The backlight 400 supplies light to the liquid crystal panel 200. The backlight may be a direct type backlight that is located below the liquid crystal panel 200.

In the backlight 400, the plurality of LEDs may be arranged in a matrix form and driven in an active matrix type.

The backlight driving circuit 500 may include a backlight control circuit 510, a scan driving circuit 520, and a light emission data driving circuit 530.

The scan driving circuit 520 are connected to a plurality of scan lines SL1 to SLn. The light emission data driving circuit 530 are connected to a plurality of light emission data lines LDL1 to LDLm.

Each scan line SL and each light emission data line LDL are connected to and drive a corresponding LED unit LEDU.

The LED unit LEDU may include the LED, a current minor circuit CMC, and a switching circuit SWC.

The switching circuit SWC is connected to the corresponding scan line SL and light emission data line LDL. The current mirror circuit CMC is connected to the switching circuit SWC. The LED is connected to the current minor circuit CMC.

Each LED may correspond to a plurality of pixels P. For example, the liquid crystal panel 200 may be divided into a plurality of pixel blocks that correspond to the plurality of LEDs, respectively, and each pixel block may include a plurality of pixels P. Accordingly, each pixel block corresponds to each LED.

The current minor circuit CMC may include first and second transistors T1 and T2. The first and second transistors T1 and T2 may be symmetrical and have substantially the same property. The first and second transistors T1 and T2 may be the same type transistor, for example, an N (negative) type transistor.

The current minor circuit CMC is connected to the corresponding light emission data line LDL through the switching circuit SWC and supplied with a corresponding light emission data signal.

The switching circuit SWC may include at least one switching elements, for example, first and second switching elements SW1 and SW2.

The first switching element SW1 is connected to a drain terminal of the first transistor T1 and the light emission data line LDL. The second switching element SW2 is connected to the drain terminal and a gate terminal of the first transistor T1. The first and second switching elements SW1 and SW2 are connected to the same scan line SL, and switched in common.

A gate terminal of the second transistor T2 is connected to the gate terminal of the first transistor T1. A drain terminal of the second transistor T2 is connected to the LED. A source terminal of the second transistor T2 is connected to a source terminal of the first transistor T1. The source terminals of the first and second transistors T1 and T2 may be grounded.

The LED is supplied with a driving voltage (VDD). A storage capacitor C may be connected to the source and gate terminals of the first transistor T1, and the source and gate terminals of the second transistor T2.

An operation of the LED unit as described above is explained in more detail as follows.

When a scan signal having an on level is applied through the scan line SL, the first and second switching elements SW1 and SW2 are turned on.

When the first and second switching elements SW1 and SW2 are turned on, a light emission data signal, for example, a light emission data current I_LDAT passes through the first and second switching elements SW1 and SW2 and is inputted to the first transistor T1. In response to the input of the light emission data current I_LDAT, the current mirror circuit CMC outputs a light emission current I_LED through the second transistor T2. The outputted light emission current I_LED is applied to the LED, and the LED emits according to the light emission current I_LED.

The current mirror circuit CMC outputs substantially the same current as an input current thereto because of its current mirror property. Accordingly, the light emission current I_LED as the output current is substantially equal to the light emission data current I_LDAT (I_LED≈I_LDAT).

Therefore, by adjusting the light emission data current (I_LDAT), brightness of the LED can be adjusted.

When a scan signal having an off level is applied, the first and second switching elements SW1 and SW2 are turned off. However, the storage capacitor C stores the voltage that was applied to the gate terminal of the second transistor T2 during the scan period of the scan line SL. Accordingly, until the next scan is performed, the LED can continue to emit light having the brightness that corresponds to the inputted light emission data current I_LDAT.

The backlight control circuit 510 may produce a scan control signal SCS to control the scan driving circuit 520 and a light emission data control signal LDCS to control the light emission data driving circuit 530, in response to the backlight control signal BCS. The backlight control circuit 510 may be configured in the timing control circuit 300.

The scan driving circuit 520 may sequentially scans the scan lines SL1 to SLn in response to the scan control signal SCS in each light emission frame. The light emission frame may be a period for which all scan lines SL1 to SLn are scanned. The light emission frame may be synchronized with the image frame. For example, the light emission frame may be synchronized such that it coincides with the image frame in timing.

The light emission data driving circuit 530 may output the light emission data currents I_LDAT to the respective light emission data lines DL1 to DLm in response to the light emission data control signal LDCS. For example, the light emission data driving circuit 530 may produce the light emission data currents I_LDAT corresponding to the light emission data signals LDAT, respectively, of each row line, and output the light emission data currents I_LDAT to the respective light emission data lines DL1 to DLm.

The output of the light emission data currents I_LDAT may be performed when each scan is performed. For example, when each scan for the scan lines SL1 to SLn is performed, the light emission data currents I_LDAT are simultaneously outputted to the respective light emission data lines DL1 to DLm. The light emission data currents I_LDAT are inputted to the respective LED units LEDU on the scanned row line. Accordingly, the LEDs of the LED unit LEDUs emit lights corresponding to the respective light emission data currents I_LDAT.

As described above, the backlight 400 is controlled by the scan driving circuit 520 and the light emission data driving circuit 530 and thus can be driven in an active matrix type. Further, each LED unit LEDU can be driven separately from others.

Since the LED unit LEDU is independently driven, a brightness of a display image can be partially controlled. Assuming that one display image has a bright portion and a dark portion. In this case, a brightness of an LED corresponding to pixels P that display the bright portion increases while a brightness of an LED corresponding to pixels P that display the dark portion decreases. According to this control for the LEDs, the bright portion is seen brighter while the dart portion is seen darker. Accordingly, contrast ratio can be improved. To do this operation, the light emission data signals LDAT may be produced in consideration of the image data signals RGB. For example, the light emission data signal LDAT of the LED unit LEDU may be produced such that it corresponds to a representative value, for example, an average value of the image data signals of the pixels of the pixel block corresponding to the LED unit LEDU.

The scan driving circuit 520 may be configured using at least one multi-channel driving IC that each includes a plurality of output terminals. For example, an n-channel driving IC, which includes n output terminals connected to the scan lines SL1 to SLn, respectively, may be used as the scan driving circuit 520.

In similar to the scan driving circuit 520, the light emission data driving circuit 530 may be configured using at least one multi-channel driving IC that each includes a plurality of output terminals. For example, an m-channel driving IC, which includes m output terminals connected to the light emission data lines LDL1 to LDLm, respectively, may be used as the light emission data driving circuit 530.

Figure 6:
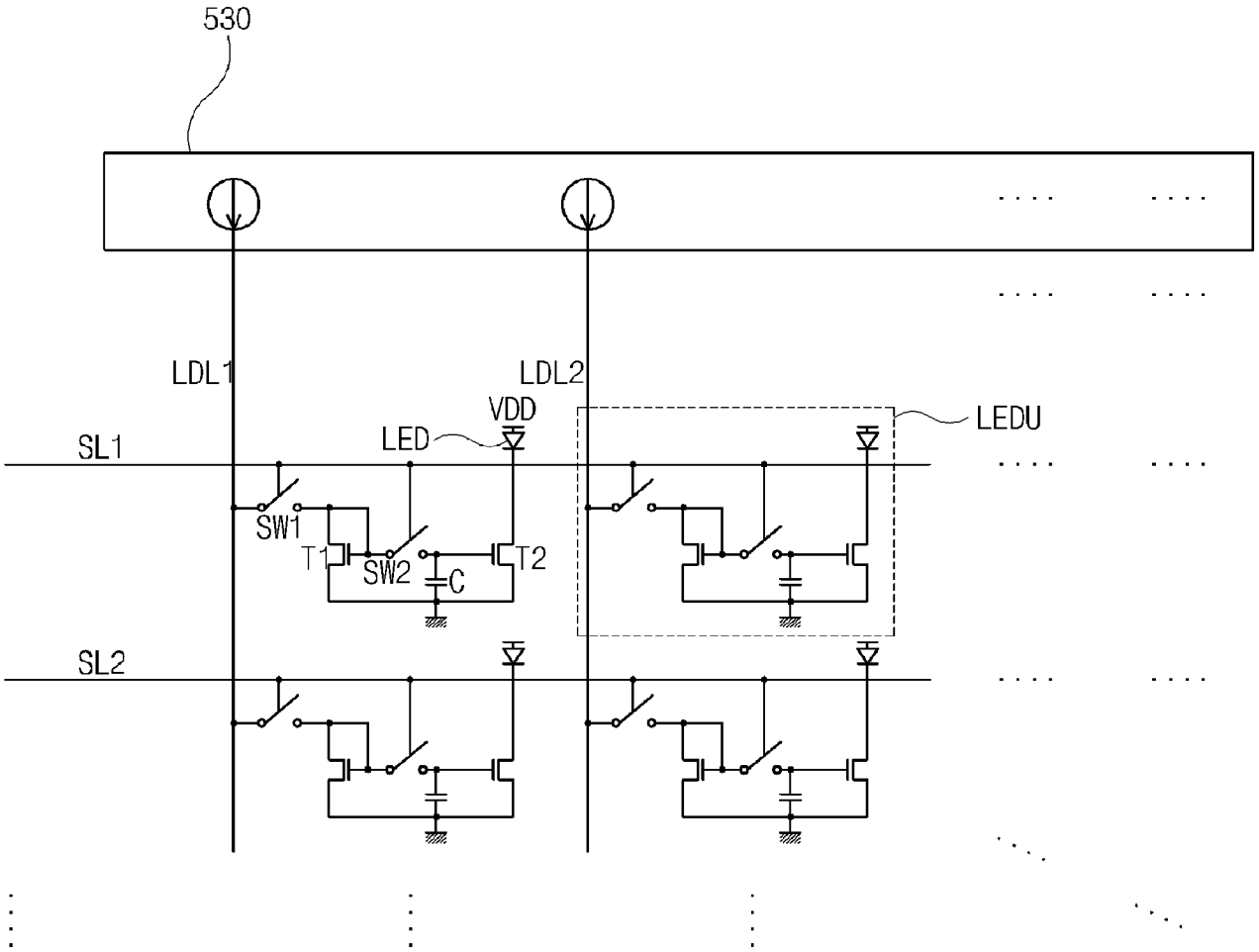
FIG. 6 is a schematic view illustrating an LED unit of an LCD device according to a second embodiment of the present invention.

FIG. 6 is a schematic view illustrating an LED unit of an LCD device according to a second embodiment of the present invention. The LCD device is similar to that of the first embodiment. Accordingly, explanations of parts similar to parts of the first embodiment may be omitted. Referring to FIG. 6, the second switching element SW2 of the second embodiment is connected to the gate terminal of the first transistor T1 and the gate terminal of the second transistor T2. The gate and drain terminals of the first transistor T1 is connected to each other.

Figure 7:
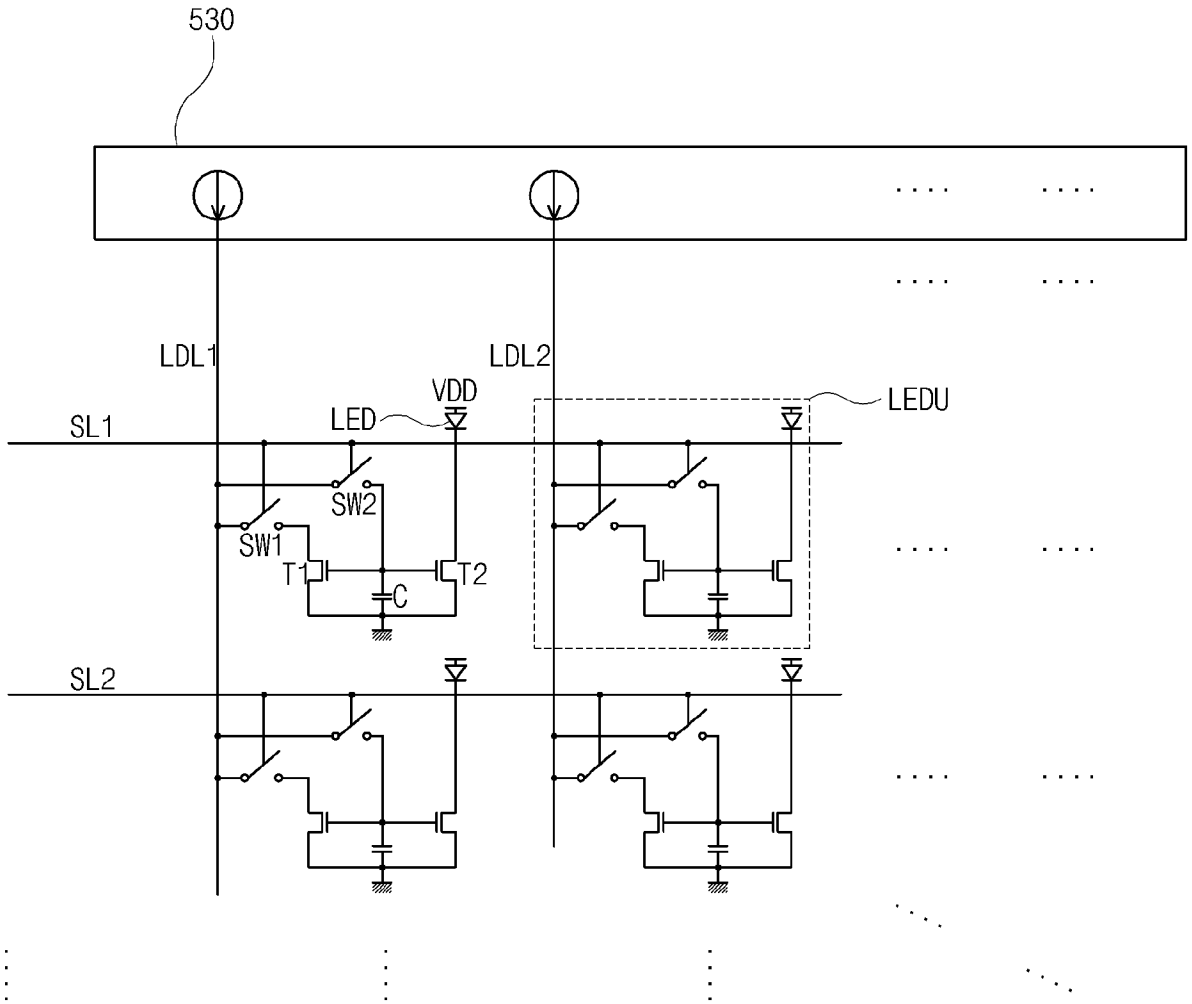
FIG. 7 is a schematic view illustrating an LED unit of an LCD device according to a third embodiment of the present invention.

FIG. 7 is a schematic view illustrating an LED unit of an LCD device according to a third embodiment of the present invention. The LCD device is similar to that of the first embodiment. Accordingly, explanations of parts similar to parts of the first embodiment may be omitted. Referring to FIG. 7, the second switching element SW2 of the third embodiment is connected to the gate terminal of the first transistor T1 and the corresponding light emission data line LDL1 or LDL2.

Figure 8:
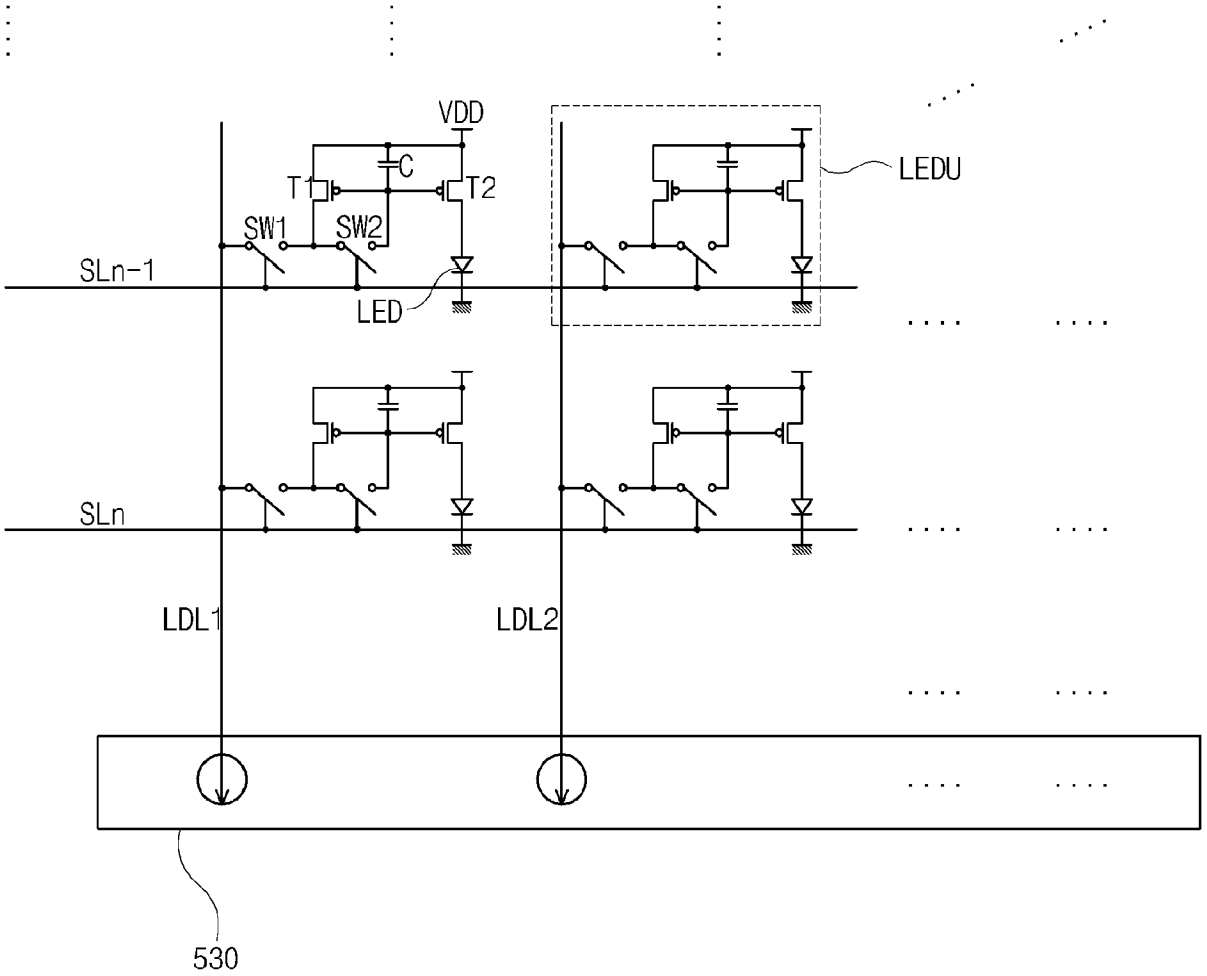
FIG. 8 is a schematic view illustrating an LED unit of an LCD device according to a fourth embodiment of the present invention.

FIG. 8 is a schematic view illustrating an LED unit of an LCD device according to a fourth embodiment of the present invention. The LCD device is similar to that of the first embodiment. Accordingly, explanations of parts similar to parts of the first embodiment may be omitted. Referring to FIG. 8, P (positive) type transistors are used as the first and second transistors T1 and T2.

Figure 9:
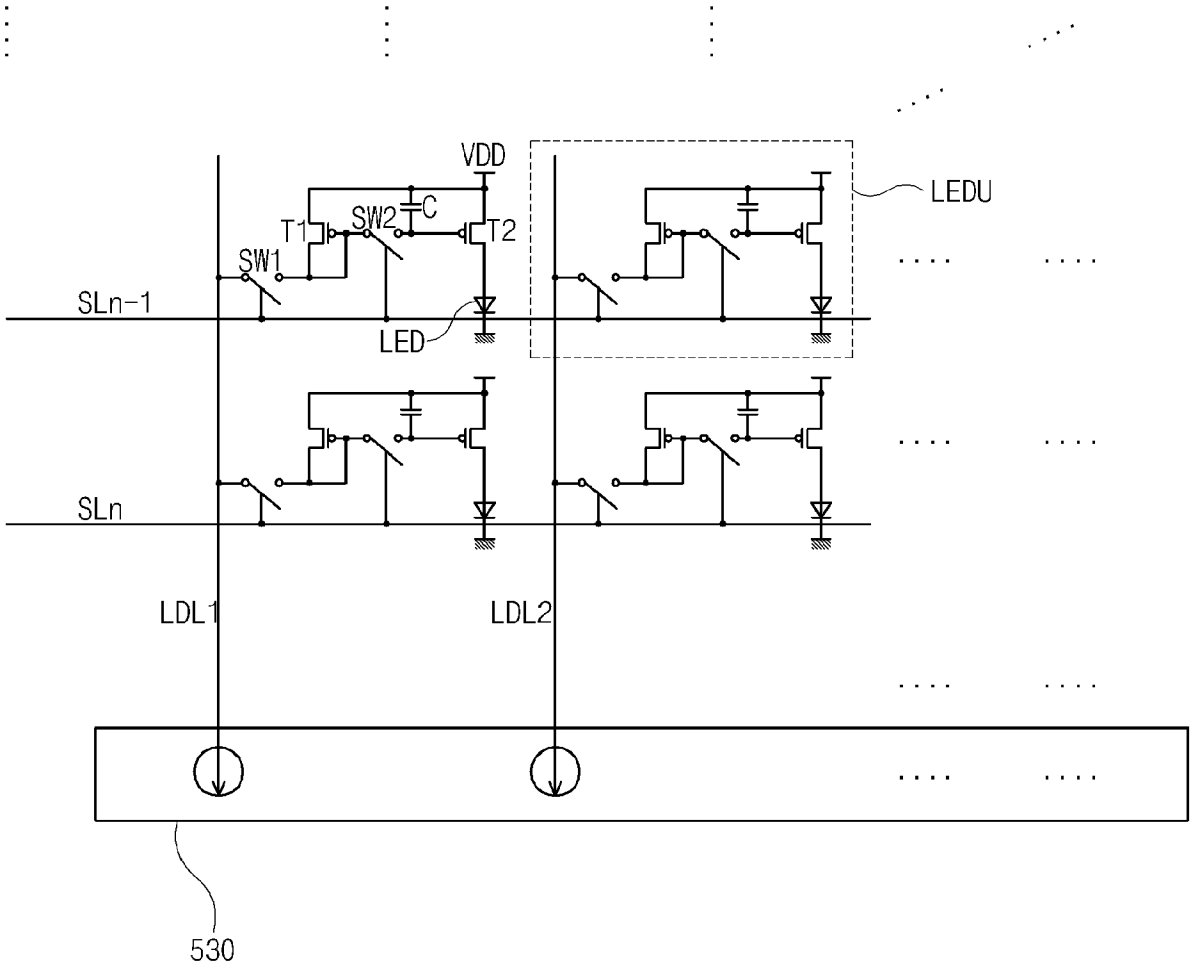
FIG. 9 is a schematic view illustrating an LED unit of an LCD device according to a fifth embodiment of the present invention.

FIG. 9 is a schematic view illustrating an LED unit of an LCD device according to a fifth embodiment of the present invention. The LCD device is similar to that of the fourth embodiment. Accordingly, explanations of parts similar to parts of the fourth embodiment may be omitted. Referring to FIG. 9, the second switching element SW2 of the fifth embodiment is connected to the gate terminal of the first transistor T1 and the gate terminal of the second transistor T2. The gate and drain terminals of the first transistor T1 is connected to each other.

Figure 10:
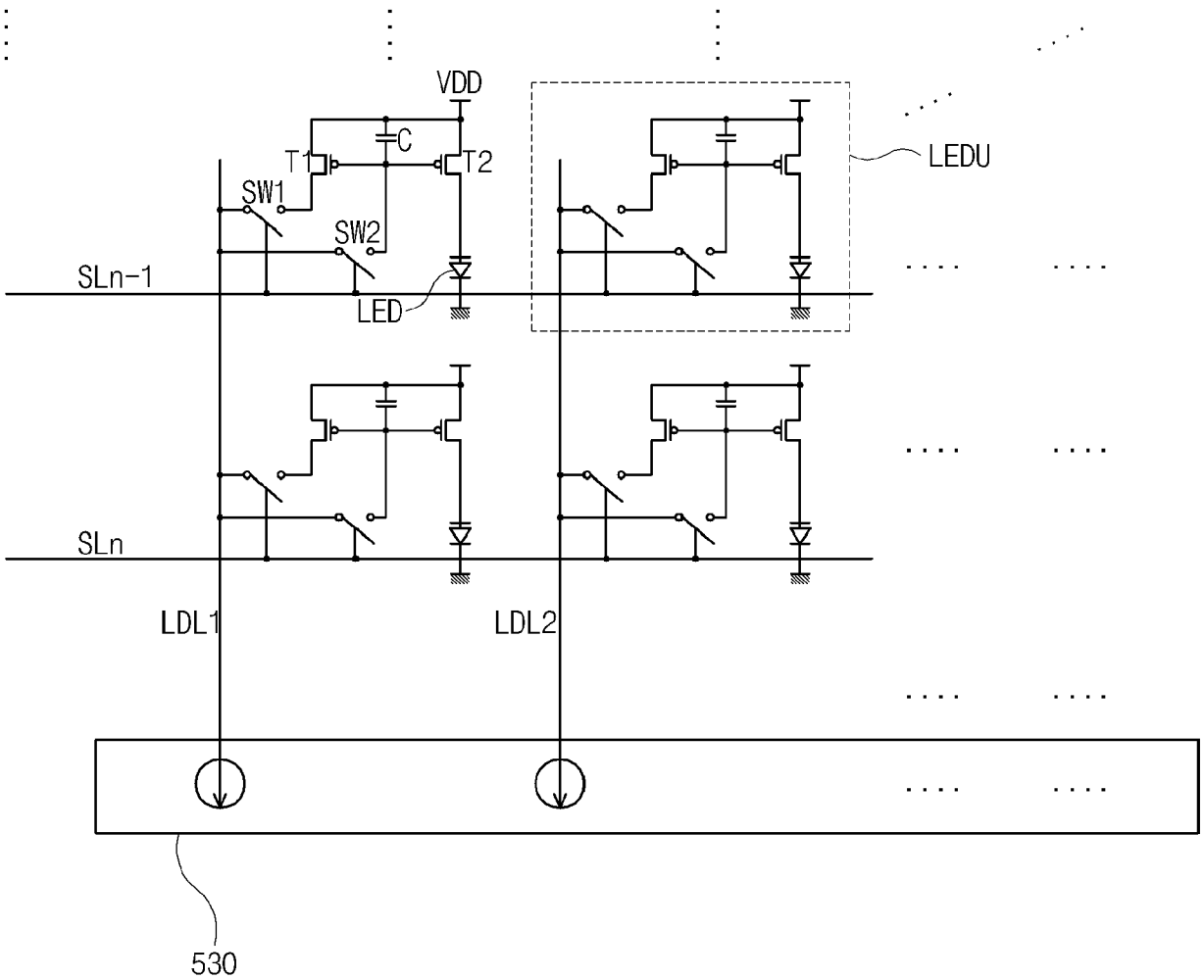
FIG. 10 is a schematic view illustrating an LED unit of an LCD device according to a sixth embodiment of the present invention.

FIG. 10 is a schematic view illustrating an LED unit of an LCD device according to a sixth embodiment of the present invention. The LCD device is similar to that of the fourth embodiment. Accordingly, explanations of parts similar to parts of the fourth embodiment may be omitted. Referring to FIG. 10, the second switching element SW2 of the sixth embodiment is connected to the gate terminal of the first transistor T1 and the corresponding light emission data line LDL1 or LDL2.

The above embodiments show variously-configured switching circuits SWC and current minor circuits CMC. However, it should be understood that switching circuits and current mirror circuits having other configurations may be employed.

Figure 11:
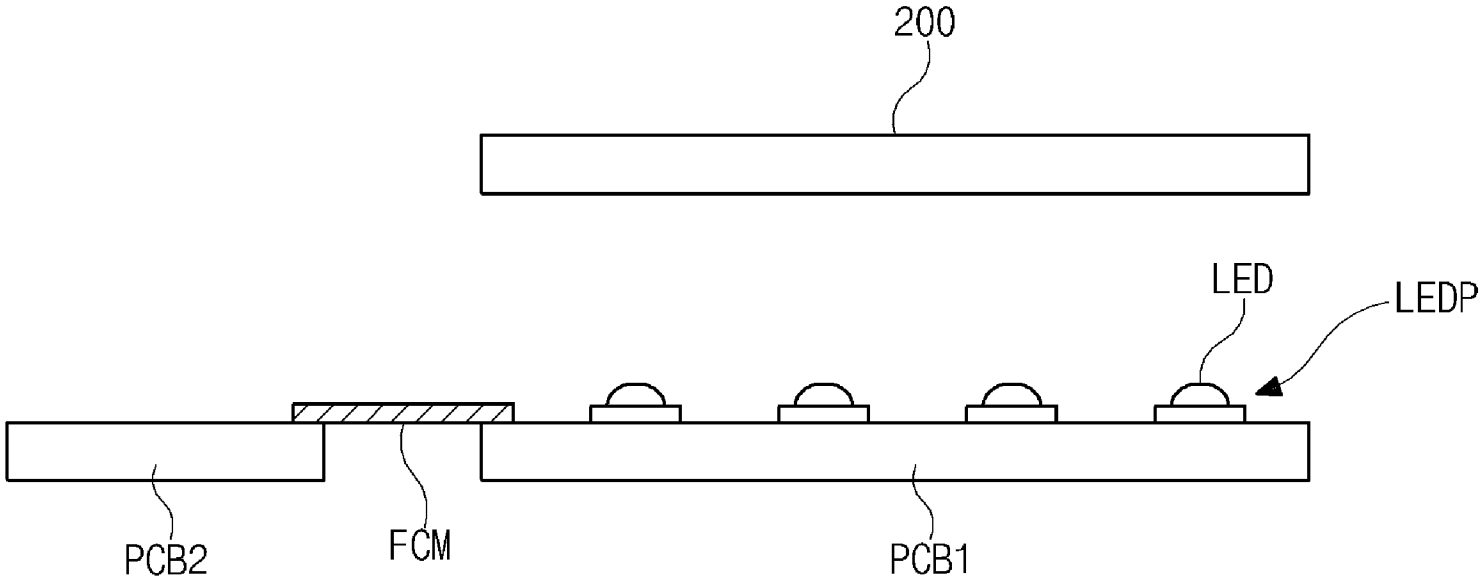
FIG. 11 is a schematic cross-sectional view illustrating an LCD device according to a seventh embodiment of the present invention.

FIG. 11 is a schematic cross-sectional view illustrating an LCD device according to a seventh embodiment of the present invention. The LCD device is similar to those of the first to sixth embodiments. The LCD device may use one of the LED units of the first to sixth embodiments.

Referring to FIG. 11, a printed circuit board (PCB), for example, a first PCB PCB1 is below a liquid crystal panel 200. A plurality of LEDs are arranged in a matrix form and mounted at the first PCB PCB1. Although not shown in the drawings, at least one optical sheet may be between the liquid crystal panel 200 and the first PCB PCB1. The at least one optical sheet may include a diffusion sheet, a prism sheet or the like.

At least one second PCB PCB2 may be located at least one side of the first PCB PCB1. A backlight driving circuit (for example, 500 of FIGS. 2 and 3) may be mounted at the second PCB PCB2. The second PCB PCB2 may be connected to the first PCB PCB1 through at least one flexible circuit means FCM. The flexible circuit means FCM has flexible property and a plurality of signal line patterns for electrical connection. The flexible circuit means FCM may be a flexible circuit film, flexible cable, or the like.

Through the flexible circuit means FCM, signals to drive the LED unit (for example, LEDU of FIG. 3) are transferred from the second PCB PCB2 into the first PCB PCB1.

The second PCB PCB2 may be located on a bottom surface of the first PCB PCB1 by bending the flexible circuit means FCM in processes of assembling components of the LCD device.

Two second PCBs PCB2 may be employed and located at the both sides, respectively, of the first PCB PCB1. In this case, a portion of the LED units on the first PCB PCB1 may be connected to and driven by one of the two second PCBs PCB2 while other portion of the LED units on the first PCB PCB1 may be connected to and driven by the other of the two second PCBs PCB2.

The LED may be fabricated in package type, and this package may be referred to as an LED package LEDP. For example, the LED package LEDP may be a combination of the LED and components to protect the LED and mount the LED on the first PCB PCB1. The LED package LEDP may be mounted on the first PCB PCB1.

In the LED package LEDP, at least one of the switching circuit and the current minor circuit (described in one of the first to sixth embodiments) forming the LED unit may be included.

Alternatively, at least one of the switching circuit and the current minor circuit may be mounted at a region of the first PCB PCB1 outside the region where the LED package LEDP is mounted. In this case, at least one of the switching circuit and the current mirror circuit may be mounted at a top or bottom surface of the first PCB PCB1. It is preferred that the at least one of the switching circuit and the current mirror circuit is mounted at the bottom surface of the first PCB PCB1. Further, the at least one of the switching circuit and the current mirror circuit outside the LED package LEDP may be fabricated in type of IC separately from the LED package LEDP and mounted at the first PCB PCB1.

Figure 12:
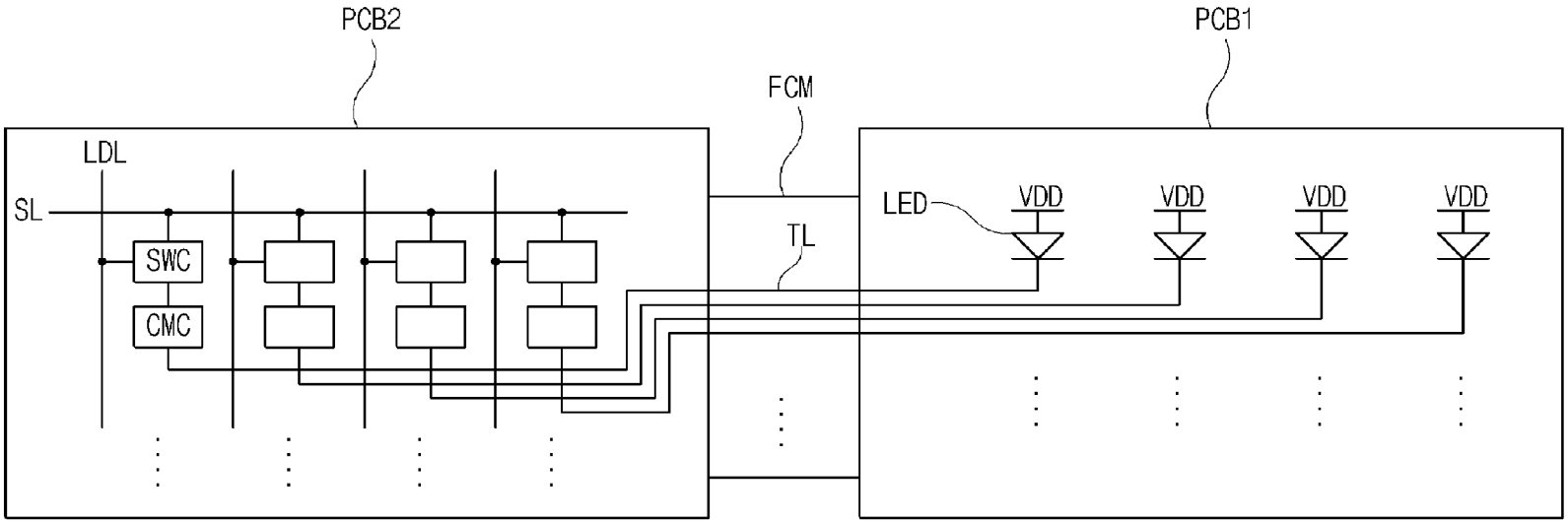
FIG. 12 is a view illustrating a configuration of an LED, a switching circuit and a current mirror circuit of an LCD device according to an eighth embodiment of the present invention.

FIG. 12 is a view illustrating configuration of an LED, a switching circuit and a current mirror circuit of an LCD device according to an eighth embodiment of the present invention. The LCD device is similar to that of the seventh embodiment. Accordingly, explanations of parts similar to parts of the seventh embodiment may be omitted.

Referring to FIG. 12, the switching circuit SWC and the current minor circuit CMC are mounted on the second PCB PCB2 along with the backlight driving circuit while the LED package (LEDP of FIG. 11) including the LED is mounted on the first PCB PCB1. The scan line SL and the light emission data line LDL are mounted on the second PCB PCB2.

The current minor circuit CMC is connected to the LED through a transfer line TL to transfer the light emission data current (I_LED of FIG. 5) outputted from the current minor circuit CMC. The transfer line TL may include line patterns formed on the second PCB PCB2, the flexible circuit means FCM and the first PCB PCB1 and electrically connect the current mirror circuit CMC and the LED. Accordingly, even though the current mirror circuit CMC and the LED are located at the different PCBs, the LED can be stably driven.

Figure 13:
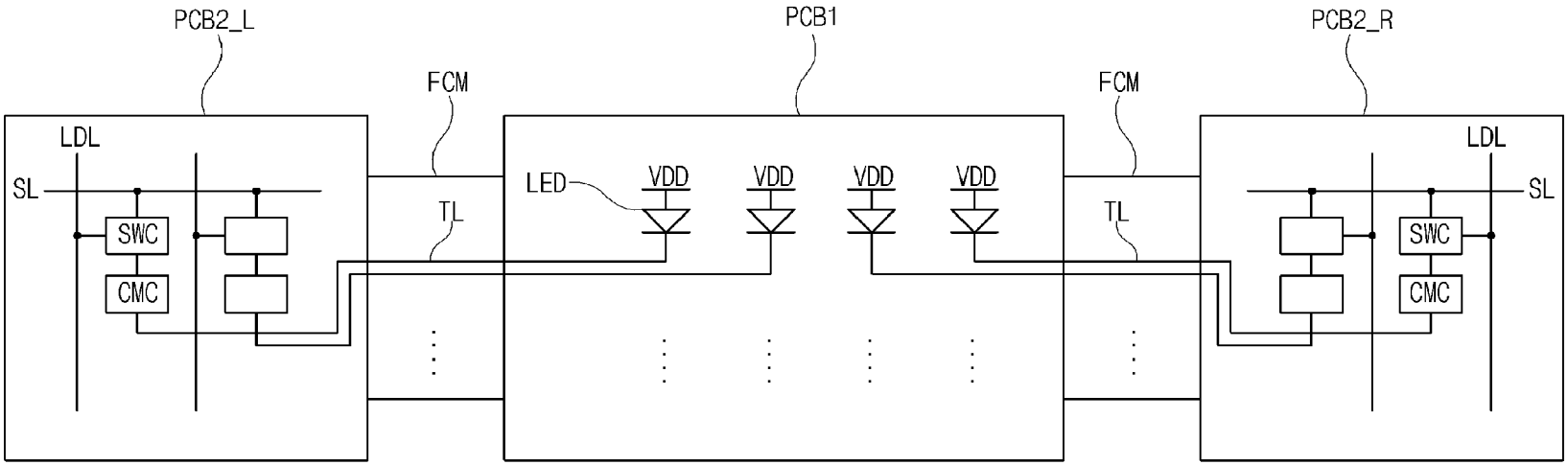
FIG. 13 is a view illustrating a configuration of an LED, a switching circuit and a current minor circuit of an LCD device according to a ninth embodiment of the present invention.

FIG. 13 is a view illustrating configuration of an LED, a switching circuit and a current mirror circuit of an LCD device according to an ninth embodiment of the present invention. The LCD device is similar to that of the eighth embodiment. Accordingly, explanations of parts similar to parts of the eighth embodiment may be omitted.

Referring to FIG. 13, the LCD device may include two second PCBs PCB2_L and PCB2_R at both sides of the first PCB PCB1. The switching circuit SWC and the current minor circuit CMC are mounted on each of the two second PCBs PCB2_L and PCB2_R while the LED package including the LED is mounted on the first PCB PCB1.

In the ninth embodiment, a portion of all LEDs is driven corresponding to the left second PCB PCB2_L while another portion of all LEDs is driven corresponding to the right second PCB PCB2_R. For example, LEDs located at a left side with respect to a vertical center line of the first PCB PCB1 are connected to and driven by the left second PCB PCB2_L while LEDs located at a right side with respect to the vertical center line of the first PCB PCB1 are connected to and driven by the right second PCB PCB2_R. Alternatively, LEDs located at an upper side with respect to a horizontal center line of the first PCB PCB1 are connected to and driven by one of the left and right second PCBs PCB2_L and PCB2_R while LEDs located at a lower side with respect to the horizontal center line of the first PCB PCB1 are connected to and driven by the other of the left and right second PCBs PCB2_L and PCB2_R. However, it should be understood that other alternative connections may be employed.

In the LCD devices according to the above embodiments, the LEDs are stably driven through the current mirror circuits, and arranged in a matrix form. Further, the LEDs are driven in an active matrix type, and are separately driven. Accordingly, prevented can be the halo phenomenon that occurs in the related art when the LEDs of each LED block are driven together. Further, brightness of the backlight can be partially adjusted, and contrast ratio can be thus improved. Therefore, display quality can be improved.

In addition, since the LEDs are separately driven, even though some LEDs are defective, the defective LEDs do not adversely affect other normal LEDs. Accordingly, prevented can be a problem that, in the related art, when at least one LED among all LEDs in one LED block is defective, all LEDs in the LED block cannot be driven due to the defective LED.

In addition, driving currents for the LEDs can be separately adjusted. Accordingly, power consumption can be reduced.

In addition, when the scan driving circuit and the light emission data driving circuit are fabricated in type of multichannel IC, costs for circuit components can be greatly reduced. This may be explained as follows.

Assuming that 720 LEDs are arranged in a 36*20 matrix. In the related art, when one block has 4 LEDs, 180 (=720/4) blocks are defined. When a 16-channel driving IC is adopted as a driving IC, about 12 16-channel driving ICs are required (because 180/16 is 11.25).

However, in the embodiments of the present invention, one 36-channel driving IC can be used as the light emission data driving circuit, and one 20-channel driving IC can be used as the scan driving circuit.

As described above, the embodiments of the present invention need two driving ICs while the related art needs 12 driving ICs. Accordingly, costs can be greatly reduced by difference of the number of driving ICs.

In addition, the LED unit may be packaged and mounted at the first PCB. This can improve packaging efficiency for the LED package and reduce area of the second PCB.

In addition, the current mirror circuit may be mounted at the second PCB different from the first PCB where the LED is mounted. This can improve area of the first PCB and simplify the LED package.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal panel;

a plurality of light emitting diode (LED) units to supply light to the liquid crystal panel; and a scan line and a light emission data line connected to each LED unit, wherein the scan line and the light emission data line transfer a scan signal and a light emission data current, respectively, wherein each LED unit includes:

a switching circuit that is connected to the scan line and the light emission data line;

a current mirror circuit that is directly connected to the switching circuit, and outputs a light emission current in response to the light emission data current; and an LED package that emits light in response to the light emission data current, the LED package including an LED and components to protect the LED and mount the LED package on a printed circuit board (PCB), wherein the LED package is mounted at a front surface of the printed circuit board, and at least one of the switching circuit and the current mirror circuit is mounted at a bottom surface of the printed circuit board opposite to the front surface.

2. The device according to claim 1, wherein the current mirror circuit includes a first transistor that is supplied with the light emission data current, and a second transistor that outputs the light emission current to the LED.

3. The device according to claim 2, wherein the switching circuit includes first and second switching elements that are switched in common in response to the scan signal, wherein the first switching element is connected to the light emission data line and a drain terminal of the first transistor, and wherein the second switching element is connected to the drain terminal and a gate terminal of the first transistor.

4. The device according to claim 2, wherein the switching circuit includes first and second switching elements that are switched in common in response to the scan signal, wherein the first switching element is connected to the light emission data line and a drain terminal of the first transistor, and wherein the second switching element is connected to a gate terminal of the first transistor and a gate terminal of the second transistor.

5. The device according to claim 2, wherein the switching circuit includes first and second switching elements that are switched in common in response to the scan signal, wherein the first switching element is connected to the light emission data line and a drain terminal of the first transistor, and wherein the second switching element is connected to the light emission data line and a gate terminal of the first transistor.

6. The device according to claim 2, further comprising a storage capacitor that is connected to a gate terminal and a source terminal of the second transistor.

7. The device according to claim 2, wherein each of the first and second transistors is a N (negative) or P (positive) type transistor.

8. The device according to claim 2, wherein a gate terminal of the first transistor is connected to a gate terminal of the second transistor.

9. The device according to claim 2, wherein a drain terminal of the second transistor is connected to the LED.

10. The device according to claim 2, wherein a source terminal of the first transistor is connected to a source terminal of the second transistor, which may be grounded.

11. The device according to claim 1, further comprising:

a scan driving circuit including at least one driving IC that includes a plurality of channels; and a light emission data driving circuit including at least one driving IC that includes a plurality of channels, wherein the channel of the scan driving circuit corresponds to the scan line, and the channel of the light emission data driving circuit corresponds to the light emission data line.

12. The device according to claim 1, wherein the light emission current is equal to the light emission data current.

* * * * *